US006634954B1

(12) United States Patent
Diaw

(10) Patent No.: US 6,634,954 B1
(45) Date of Patent: Oct. 21, 2003

(54) MINIATURE BOWLING GAME

(76) Inventor: Ibrahima Diaw, 157 Cross St., Apt. #1, Central Falls, RI (US) 02863

( * ) Notice: Subject to any disclaimer, the term of this patent is extended or adjusted under 35 U.S.C. 154(b) by 0 days.

(21) Appl. No.: 10/100,412

(22) Filed: Mar. 18, 2002

(51) Int. Cl.[7] ..... A63B 67/00

(52) U.S. Cl. ..... 473/116; 273/108.1; 273/119 R; 273/129 S; 273/129 W

(58) Field of Search ..... 273/108, 108.1, 273/108.53, 108.55, 119 R, 120 R, 129 R, 129 S, 129 V, 129 W; 473/116, 54

(56) References Cited

U.S. PATENT DOCUMENTS 135,494 A * 2/1873 Smith
512,104 A * 1/1894 Fishel
529,802 A * 11/1894 Olsson
1,598,214 A * 8/1926 Milewski
1,608,447 A * 11/1926 Wade
1,681,590 A * 8/1928 Marczinko
1,859,220 A * 5/1932 Richards
2,473,091 A * 6/1949 Brooks et al.
2,642,058 A * 6/1953 Murphy
3,140,093 A * 7/1964 Singer
3,214,171 A * 10/1965 Luchsinger ..... 273/108.5
3,857,562 A * 12/1974 Rardon et al.
3,865,377 A * 2/1975 Cooper et al.
3,891,216 A * 6/1975 Ensmann et al. ..... 273/119 R
4,213,612 A * 7/1980 Wildman et al. ..... 463/60
4,869,513 A * 9/1989 Auer et al. ..... 463/56

* cited by examiner

*Primary Examiner*—William M. Pierce

(57) ABSTRACT

A miniature bowling game is provided, comprising a base structure having an elongated bowling alley with diverging sidewalls, a gutter along each sidewall, a ball, a ball shooting apparatus pivotally associated with a semi-circular region at the front of the bowling alley, a rear facing wall, and pins that may be positioned at the end of the bowling alley along the rear facing wall. In one embodiment, a pin catching apparatus is situated between the bowling alley and the rear facing wall. The miniature bowling game has particular utility in connection with improving reflexes and coordination during entertainment.

6 Claims, 5 Drawing Sheets

MINIATURE BOWLING GAME

BACKGROUND OF THE INVENTION

1. Field of the Invention

The present invention relates to a miniature bowling game for use in connection will entertainment. The miniature bowling game has particular utility in connection with improving reflexes and coordination during entertainment.

2. Description of the Prior Art

Miniature bowling games are desirable for entertainment and for improving reflexes and coordination.

The use of bowling games is known in the prior art. For example, U.S. Pat. No. 4283,049 to Karlin et al. discloses a bowling ball game. However, the bowling ball game of the Karlin '049 patent does not have actual pins, and has a further drawback of providing different scores even though balls traverse the same routes.

U.S. Pat. No. 5,096,192 to Stanford, Jr. discloses a miniature bowling game that has a contoured lane surface. However, the miniature bowling game of the Stanford. Jr. '192 patent does not simulate a full-size bowling alley, since a full-size alley has a flat surface.

U.S. Pat. No. 1,329,952 to Bond discloses a toy bowling alley. However, it is not easy to pivot the ball projecting apparatus of the toy bowling alley of the Bond '952 patent.

Similarly, U.S. Pat. No. 3,951,408 to Reiner et al. discloses a pendulum bowling game. However, the pendulum bowling game of the Reiner '408 patent does not allow the pedulum shooter to pivot, and additionally does not simulate a full-size bowling alley with a flat alley, but rather provides a curved alley.

U.S. Pat. No. 3,764,136 to Breslow et al. discloses a game apparatus that simulates a bowling type game. However, the game apparatus of the Breslow '136 patent does not allow the ball propulsion device to be easily pivoted.

Similarly, U.S. Pat. No. Des. 309,922 to Jorgensen discloses an ornamental design for a mini-bowling game. However, the Jorgensen '922 patent does not describe a ball propulsion device that may be pivoted.

Lastly, U.S. Pat. No. 2,610,618 to Huber discloses a ball hurling device for simulated bowling. However, the ball hurling device of the Huber '618 is not easily pivoted, and has the additional deficiency of a cumbersome design with no easy method of attachment to a miniature game board.

While the above-described devices fulfill their respective, particular objectives and requirements, the aforementioned patents do not describe a miniature bowling game with a flat bowling alley and a simple and easy to use pivotable ball shooting apparatus that allows for improving reflexes and coordination during entertainment.

Therefore, a need exists for a new and improved miniature bowling game that can be used for entertainment and for improving reflexes and coordination. In this regard, the present invention substantially fulfills this need. In this respect, the miniature bowling game according to the present invention substantially departs from the conventional concepts and designs of the prior art, and in doing so provides an apparatus primarily developed for the purpose of entertainment and improving reflexes and coordination.

SUMMARY OF THE INVENTION

In view of the foregoing disadvantages inherent in the known types of bowling games now present in the prior art, the present invention provides an improved miniature bowling game and overcomes the above-mentioned disadvantages and drawbacks of the prior art. As such the general purpose of the present invention, which will be described subsequently in greater detail, is to provide a new and improved miniature bowling game and method which has all the advantages of the prior art mentioned heretofore and many novel features that result in a miniature bowling game which is not anticipated, rendered obvious, suggested, or even implied by the prior art, either alone or in any combination thereof.

To attain this, the present invention essentially comprises a miniature bowling game comprising a base structure having an elongated bowling alley with diverging sidewalls, a ball, a ball shooting apparatus pivotally associated with a semi-circular region at the front of the bowling alley, a rear facing wall, and a plurality of pins positionable along the rear facing wall.

There has thus been outlined, rather broadly, the more important features of the invention in order that the detailed description thereof that follows may be better understood and in order that the present contribution to the art may be better appreciated.

The invention may also include gutters and a pin catching apparatus. There are of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved miniature bowling game that has all of the advantages of the prior art bowling games and none of the disadvantages.

It is another object of the present invention to provide a new and in-proved miniature bowling game that may be easily and efficiently manufactured and marketed.

An even further object of the present invention is to provide a new and improved miniature bowling game that has a low cost of manufacture with regard to both materials and labor, and which accordingly is then susceptible of low prices of sale to the consuming public. thereby making such miniature bowling game economically available to the buying public.

Still another object of the present invention is to provide a new miniature bowling game that provides in the apparatuses and methods of the prior art some of the advantages thereof, while simultaneously overcoming some of the disadvantages normally associated therewith.

Even still another object of the present invention is to provide a miniature bowling game for entertainment.

Still yet another object of the present invention is to provide a miniature bowling game for improving reflexes and coordination. This makes it possible to improve reflexes and coordination during entertainment.

Lastly, it is an object of the present invention to provide a new and improved method of entertainment using a miniature bowling game comprising a base structure having an elongated bowling alley with diverging sidewalls, a gutter along each sidewall, a ball, a ball shooting apparatus pivotally associated with a semi-circular region at the front of the bowling alley, a rear facing wall, and a plurality of pins positionable along the rear facing wall.

These together with other objects of the invention, along with the various features of novelty that characterize the invention, are pointed out with particularity in the claims annexed to and foaming a part of this disclosure. For a better understanding of the invention its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above with become apparent when consideration is given to the following detailed description thereof Such description makes reference to the annexed drawings wherein.

The same reference numerals refer to the same parts throughout the various figures.

DESCRIPTION OF THE PREFERRED EMBODIMENT

Figure 1:
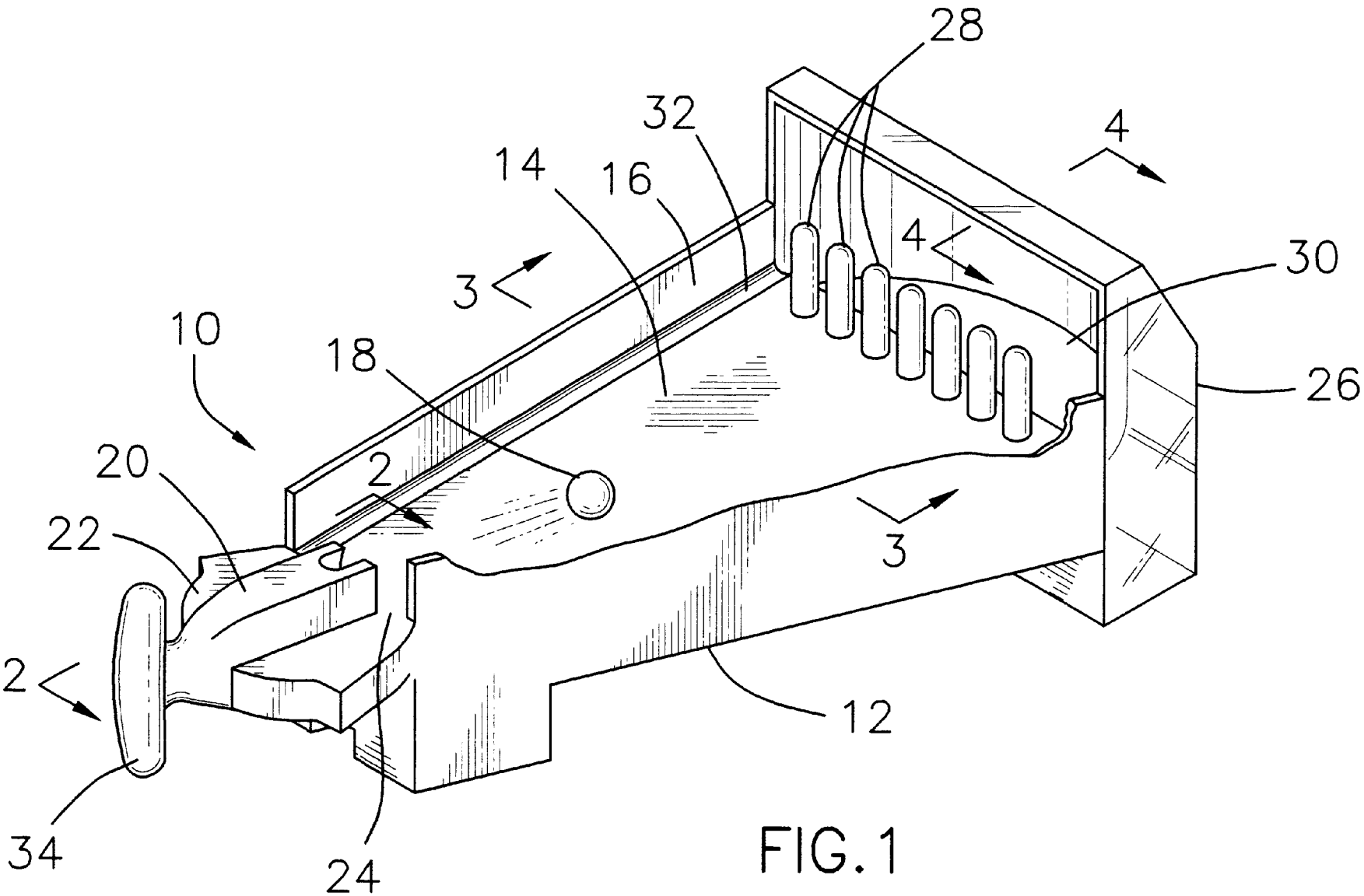
FIG. 1 is a right perspective view of the preferred embodiment of the miniature bowling game constructed in accordance with the principles of the present invention.

Referring now to the drawings, and particularly to FIGS. 1–5, a preferred embodiment of the miniature bowling game of the present invention is shown and generally designated by the reference numeral 10.

In FIG. 1, a right perspective view of a preferred embodiment of the new and improved miniature bowling game 10 of the present invention for entertainment and for improving reflexes and coordination is illustrated and will be described. More particularly, the miniature bowling game 10 has a base structure 12 having an elongated bowling alley 14 with a diverging sidewall 16 on each side, a ball 18, a ball shooting apparatus 20 pivotally associated with a sermi-circular region 22 at the front of the bowling alley 24, a rear facing wall 26, and a plurality of pins 28 positionable along the rear facing wall 26. Between the pins 28 and the rear facing wall 26 is a pin catching apparatus 30. Between the bowling alley 14 and the diverging sidewall 16 is a gutter 32 on each side of the bowling alley 14. The main feature of the ball shooting apparatus 20 that is visible in this figure is a handle 34.

Figure 2:
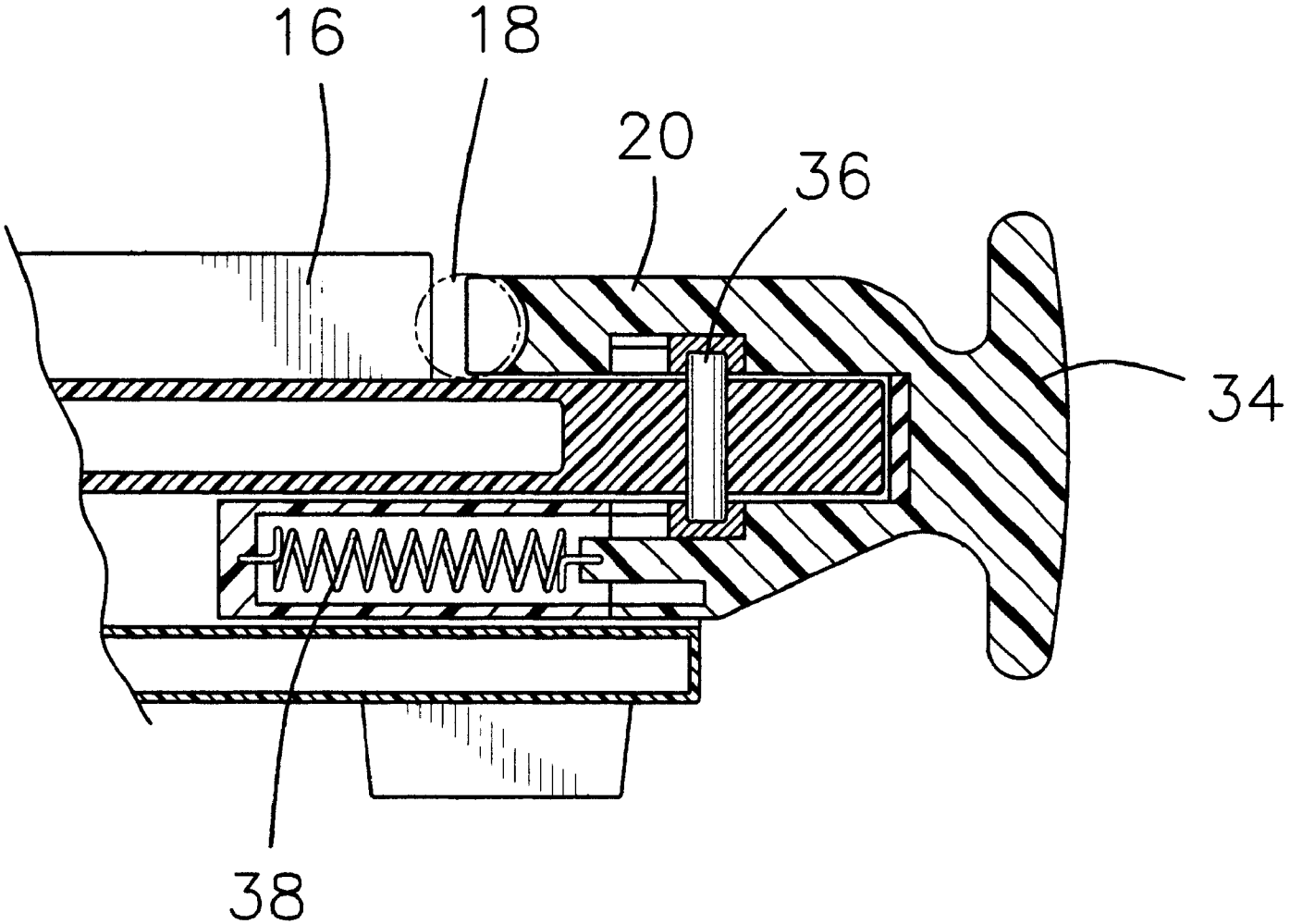
FIG. 2 is a left cross-sectional view of the front section of the miniature bowling game of the present invention.

FIG. 2 is a left cross-sectional view of the front section of the miniature bowling game of the present invention, and illustrates the inner workings of the ball shooting apparatus 20. When the handle 34 is pulled back, the pin 36 controls how far the handle 34 can be pulled, and the spring 38 is put under tension. When the handle 34 is released, the spring 38 pulls the ball shooting apparatus 20 forward, thus propelling the ball 18 forward across the bowling alley 14 between the two sidewalls 16. The spring preferably comprises an elastic metal material.

Figure 3:
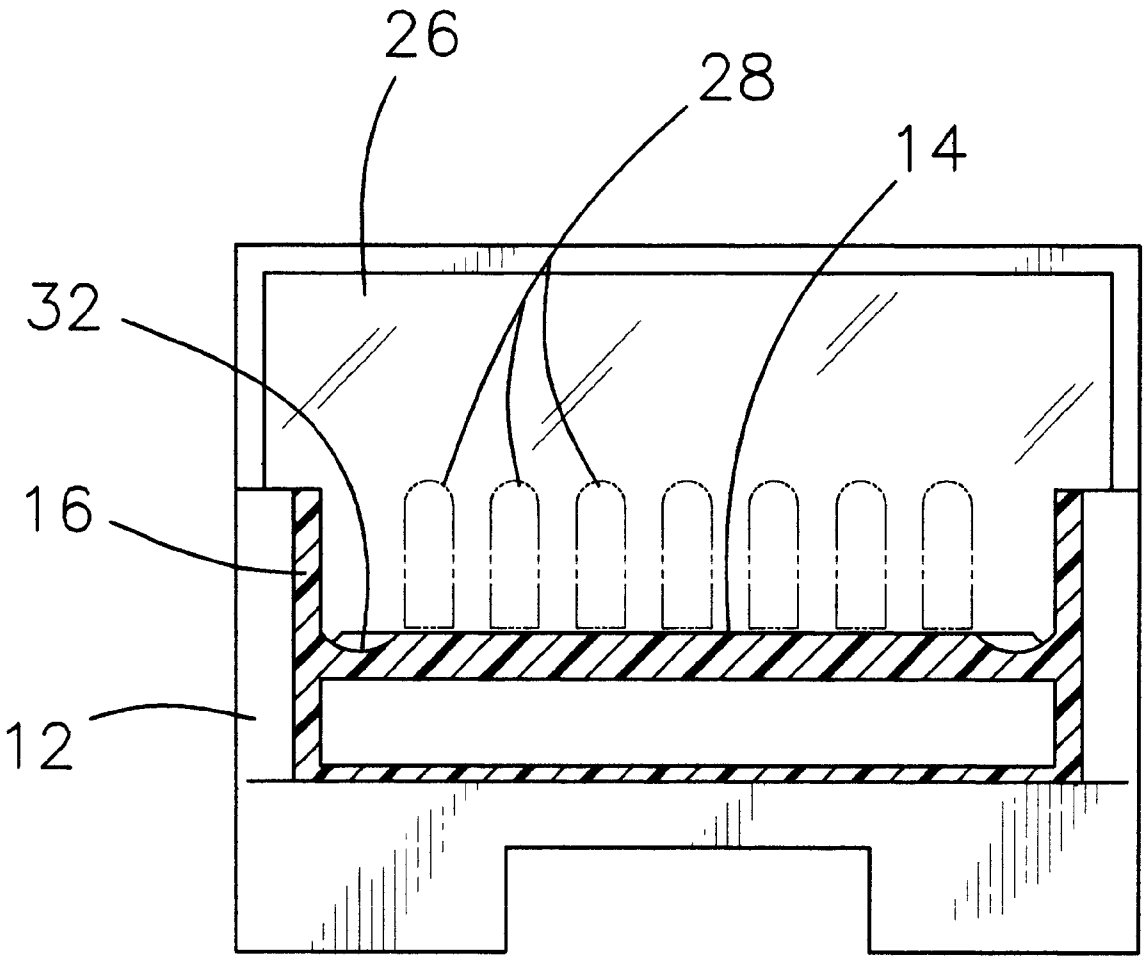
FIG. 3 is a front cross-sectional view of the rear section of the miniature bowling game of the present invention.

FIG. 3 is a front cross-sectional view of the rear section of the miniature bowling game of the present invention and illustrates the relative positions of the base structure 12, bowling alley 14, gutters 32, and sidewalls 16, as well as the placement of the pins 28 in front of the rear facing wall 26.

Figure 4:
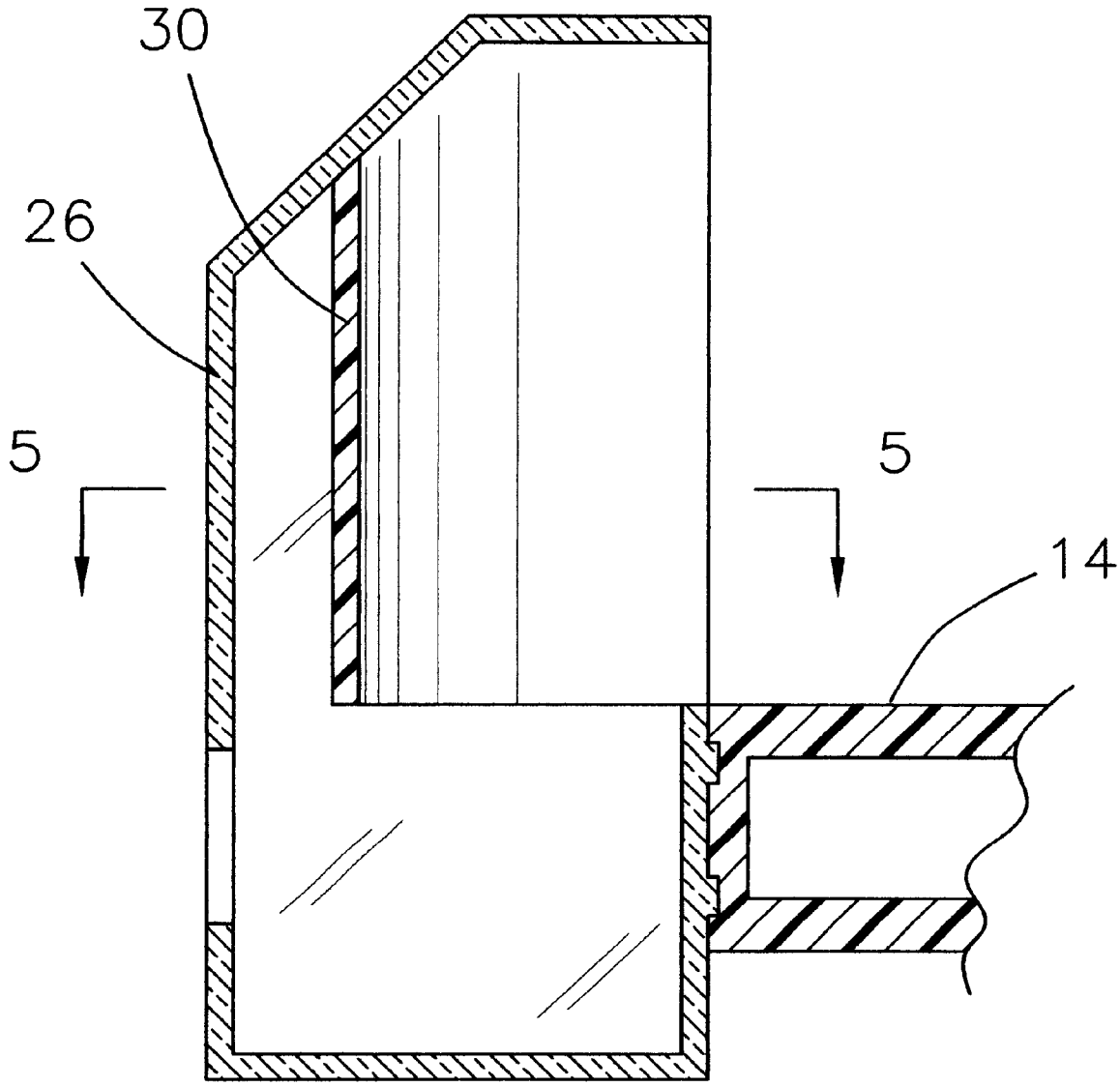
FIG. 4 is a left cross-sectional view of the rear section of the miniature bowling game of the present invention.

FIG. 4 is a left cross-sectional view of the rear section of the miniature bowling game of the present invention and illustrates the pin catching apparatus 30 between the rear facing wall 26 and the bowling alley 14.

Figure 5:
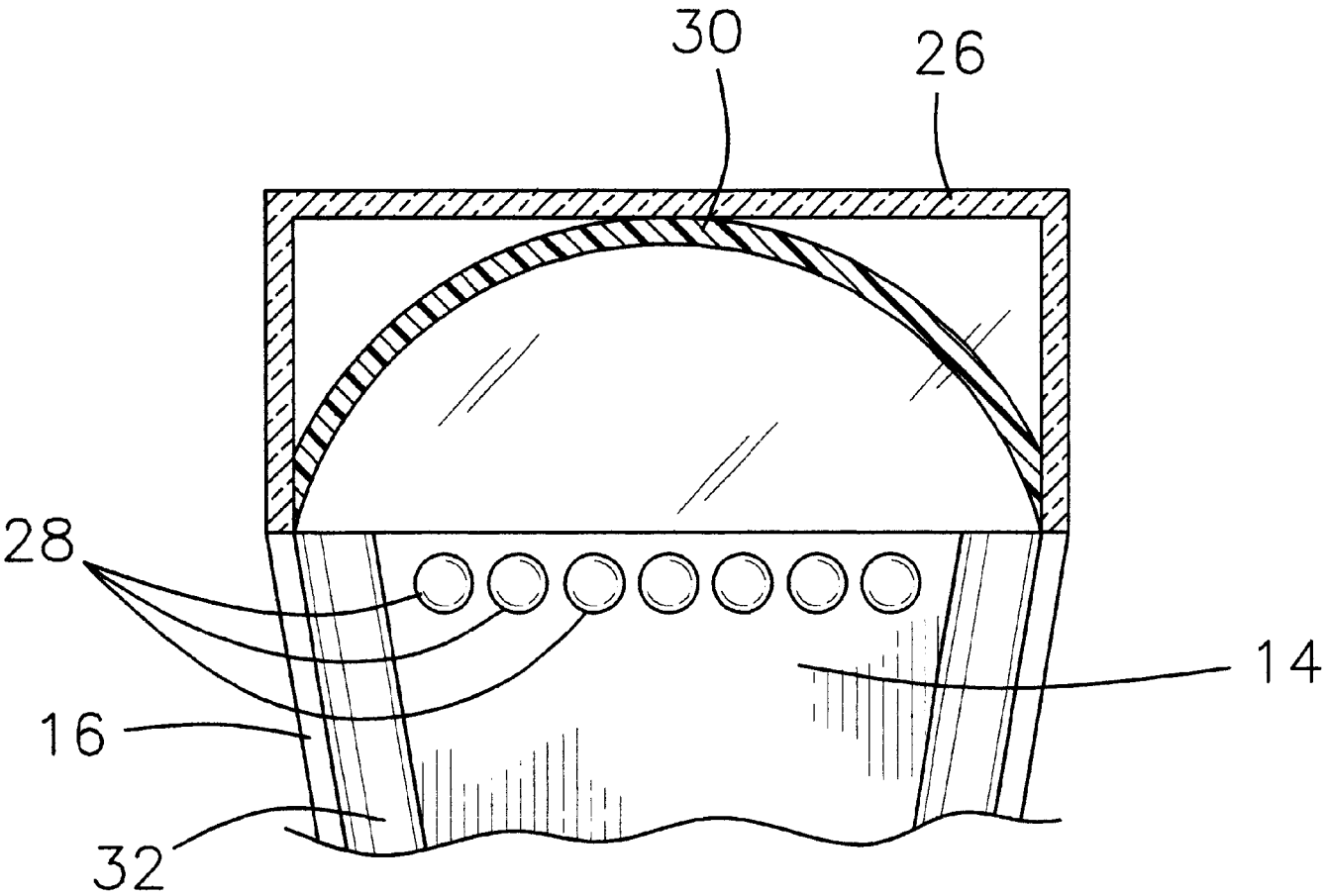
FIG. 5 is a top cross-sectional view of the rear section of the miniature bowling game of the present invention.

FIG. 5 is a top cross-sectional view of the rear section of the miniature bowling game of the present invention and illustrates the relative positions of the bowling alley 14, gutters 32, and sidewalls 16. The pin catching apparatus 30 is illustrated with a concave shape. Between the rear facing wall 26 and pins 28 positioned at the rear edge of the bowling alley 14. It is penetrable for the pins 28 to be positioned in a straight line along the rear facing wall 26, at the rear edge of the bowling alley 14 with the pin catching apparatus 30 situated between the rear facing wall 26 and pins 28 positioned at the rear edge of the bowling alley 14. When the pins 28 of the miniature bowling game of the present invention are positioned in a straight line rather than the triangular placement in a conventional bowling alley and in the games of the prior art, a more challenging game results since it is more difficult to knock down all of the pins with one ball. This leads to better entertainment and greater development of reflexes and coordination since more turns are required of a player in order to knock down all of the balls, resulting in a more competitive game.

The miniature bowling game of the present invention and its associated parts may be constructed of plastic, wood, or any other suitable rigid material. The miniature bowling game of the present invention and its associated parts preferably comprise rigid plastic. The plastic may be polypropylene (PP), a polyethylene (PE) such as high density polyethylene (HDPE). polystyrene (PS), an acrylonitrile-butadiene-styrene (ABS) resin, a styrene-acrylonitrile (SAN) resin, polycarbonate (PC), a polyester such as polyethylene terephthalate (PET) or polybtitylene terephthalate (PBT), or blends thereof, as well as any other suitable plastic material known to those skilled in the art. It is preferable for some of the parts of the miniature bowling game of the present invention, such as the sidewalls and the pin catching apparatus, to be constructed of clear plastic. It is preferred for the bowling alley 14 to be substantially flat to simulate a full-size bowling alley.

In one embodiment of the miniature bowling game of the present invention, the size and weight of the pins are in substantially the same proportion to the size and weight of the ball, as the size and weight of bowling pins are to bowling balls.

In a preferred embodiment, the miniature bowling game of the present invention comprises a plastic unit measuring approximately 14 inches long, 7⅜ inches wide, and 4⅜ inches high. The unit features a front spring-loaded plunger that sends a plastic bail down the bowling alley. The plunger features a front exit chute and is mounted on a swivel mount to allow the ball to be aimed at a desired angle. The end of the alley features an area in which seven plastic pins can be placed in a row. A concave pin-catching area is located behind the pins. The rear of the unit is covered by a transparent plastic, thus preventing the ball and pins from being ejected from the unit.

In one embodiment of the miniature bowling game of the present invention, to play the game players can take turns shooting the ball towards the pins. When one player has managed to knock down all the pins, the pins can be set up again, and the turn would move to the next player. The object of the game can be to knock down all the pins in as few attempts as possible.

The present invention fulfills the need for a fun, new type of coordination game. The appealing features of the miniature bowling game of the present invention include its ease of use. affordability, and entertainment value. A key factor in the appeal of the miniature bowling game of the present invention is the simplicity of its design. Even a beginner is able to play the game, but it takes timing and coordination to effectively hit the pins. The challenge presented by the miniature bowling game of the present invention can keep both young and older children, as well as adults, entertained for extended periods of time. Children can practice together and have contests for knocking down all the pins in the fewest attempts. The miniature bowling game of the present invention can be produced in various sizes, and can be played indoors or outdoors. The miniature bowling game of the present invention can be produced with many unique and original appearances, and can be produced from durable materials for fears of effective use.

The increased entertainment and improvement of reflexes and coordination afforded by the miniature bowling game of the present invention result from the gameboard having a ball shooting apparatus pivotally associated with a semi-circular region which features diverging sidewalls. With pins aligned in a straight line along the end of the alley in front of the pin catching apparatus and rear facing wall rather than the triangular placement in a conventional bowling alley and in the games of the prior art, a more challenging game results since it is more difficult to knock down all of the pins with one ball. This leads to better enteilaimnent and greater development of reflexes and coordination since more turns are required of a player in order to knock down all of the balls, resulting in a more competitive game. Alter some pins have been knocked down, the player must re-aim the ball shooting apparatus by pivoting it and pointing it at the remaining pins in order to knock them down also. The result is greater development of reflexes and coordination.

In use, it can now be understood that the miniature bowling game of the present invention affords increased entertainment and improvement of reflexes and coordination. While a preferred embodiment of the miniature bowling game has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, cardboard, laminated materials or wood composite materials may be used instead of the plastic or wood described. Also, the bowling alley may have a curvature rather than being substantially flat. And although entertainment and improvement of reflexes and coordination have been described, it should be appreciated that the miniature bowling game herein described is also suitable for improving concentration and sportsmanship. Furthermore, a wide variety of pin placement geometries may be used instead of the straight line described.

Therefore, the foregoing is considered as illustrative only of the principles of the invention. Further, since numerous modifications and changes will readily occur to those skilled in the art, it is not desired to limit the invention to the exact constriction and operation shown and described, and accordingly, all suitable modifications and equivalents may be resorted to, falling within the scope of the invention.

I claim:

1. A miniature bowling game comprising:

a substantially flat base structure having an elongated bowling alley with a narrow front semi-circular region with diverging sidewalls extending to a wider rear facing wall;

a gutter along each sidewall;

a ball;

a ball shooting apparatus pivotally associated with the semi-circular region at the front of the bowling alley;

a plurality of pins positionable along the rear facing wall; and a pin catching apparatus having a concave shape.

2. The miniature bowling game of claim 1, wherein the plurality of pins are positioned in a straight line along the rear facing wall.

3. The miniature bowling game of claim 1, wherein the weight ratio of each pin to the ball is in the range of about 1/2.5 to about 1/5.5 to provide substantially the same proportion as the weight of a standard tenpin bowling alley pin to a standard bowling ball.

4. A method of entertainment using a miniature bowling game comprising:

providing a substantially flat base structure having an elongated bowling alley with a narrow front semi-circular region with diverging sidewalls extending to a wider rear facing wall, a gutter along each sidewall, a ball, a ball shooting apparatus pivotally associated with the semi-circular region at the front of the bowling alley, a plurality of pins positionable along the rear facing wall, and a pin catching apparatus having a concave shape; and shooting the ball at the pins.

5. The method of claim 4, wherein the plurality of pins are positioned in a straight line along the rear facing wall.

6. The method of claim 4, wherein the weight ratio of each pin to the ball is in the range of about 1/2.5 to about 1/5.5 to provide substantially the same proportion as the weight of a standard tenpin bowling alley pin to a standard bowling ball.

* * * * *